US012474147B2

(12) United States Patent
Keyes et al.

(10) Patent No.: US 12,474,147 B2
(45) Date of Patent: Nov. 18, 2025

(54) GROUNDING SABOT AND METHODS OF USE

(71) Applicant: Defiant Engineering, LLC, Odessa, TX (US)

(72) Inventors: Cullen Craig Keyes, Hysham, MT (US); Ian Graham Janke, Parkland County (CA)

(73) Assignee: Defiant Engineering, LLC, Odessa, TX (US)

( * ) Notice: Subject to any disclaimer, the term of this patent is extended or adjusted under 35 U.S.C. 154(b) by 0 days.

(21) Appl. No.: 19/051,950

(22) Filed: Feb. 12, 2025

(65) Prior Publication Data

US 2025/0264314 A1 Aug. 21, 2025

Related U.S. Application Data

(60) Provisional application No. 63/554,046, filed on Feb. 15, 2024.

(51) Int. Cl.
*F42B 14/06* (2006.01)
*E21B 43/116* (2006.01)

(52) U.S. Cl.
CPC ..... *F42B 14/06* (2013.01); *E21B 43/116* (2013.01)

(58) Field of Classification Search
CPC .. E21B 43/117; E21B 43/116; E21B 43/1185; E21B 43/119; E21B 29/02;
(Continued)

(56) References Cited

U.S. PATENT DOCUMENTS 2,565,789 A 8/1951 Tow
3,714,900 A 2/1973 Feldmann
(Continued)

FOREIGN PATENT DOCUMENTS

CN 103562493 A 2/2014
CN 208934668 U 6/2019
(Continued)

OTHER PUBLICATIONS

International Search Report and Written Opinion received for PCT Patent Application No. PCT/US2025/015699, mailed on May 5, 2025, 10 pages.
(Continued)

*Primary Examiner* — Michael D David
(74) *Attorney, Agent, or Firm* — Workman Nydegger

(57) ABSTRACT

A sabot that includes a body configured to be partly received within a propellant chamber of a perf gun, and the body includes an interface configured to engage a projectile, a divider that defines part of the interface, an ignition pass through that extends through the divider, an ignition stack electrically connected to the ignition pass through, a ground terminal electrically connected to the ignition pass through, a deflector defined by the divider and having a cup-shaped configuration, and the deflector is configured to expand diametrically upon ignition of a propellant in the propellant chamber when the sabot is positioned within the propellant chamber, a gas valve configured and arranged to be actuated by expansion of the deflector, and a compensator positioned between the interface and the gas valve.

14 Claims, 7 Drawing Sheets

(58) Field of Classification Search
CPC .. F42B 3/08; F42B 1/02; F42B 10/025; F42B 10/08; F42B 10/28; F42B 14/06
USPC ..... 89/1.15; 102/306, 518, 523, 476, 477, 102/491, 520
See application file for complete search history.

(56) References Cited

U.S. PATENT DOCUMENTS

| | | | | |
|---|---|---|---|---|
| 4,123,975 | A | 11/1978 | Mohaupt | |
| 4,299,287 | A | 11/1981 | Vann et al. | |
| 4,387,773 | A | 6/1983 | Mc Phee | |
| 4,651,649 | A * | 3/1987 | Nussbaum | F42B 14/06 102/521 |
| 4,753,172 | A | 6/1988 | Katzmann et al. | |
| 4,881,445 | A | 11/1989 | Hayes | |
| 4,970,960 | A * | 11/1990 | Feldmann | F42B 12/06 102/501 |
| 5,182,419 | A * | 1/1993 | Burnette | F42B 14/064 102/523 |
| 5,415,102 | A | 5/1995 | White | |
| 5,765,637 | A | 6/1998 | Dietle et al. | |
| 9,175,939 | B1 * | 11/2015 | Wilfong | F42B 5/105 |
| 10,577,129 | B1 * | 3/2020 | Poulsen | F42B 5/03 |
| 10,591,263 | B2 | 3/2020 | Brown et al. | |
| 11,867,487 | B1 | 1/2024 | Wach et al. | |
| 2003/0110973 | A1 * | 6/2003 | Mutascio | F42B 30/10 102/498 |
| 2011/0094406 | A1 | 4/2011 | Marya et al. | |
| 2012/0247771 | A1 | 10/2012 | Black et al. | |
| 2017/0080498 | A1 * | 3/2017 | Burrow | B22F 3/225 |
| 2018/0154446 | A1 * | 6/2018 | Brown | F42B 10/24 |
| 2019/0085665 | A1 | 3/2019 | Al-Gouhi | |
| 2019/0153828 | A1 | 5/2019 | Tolman et al. | |
| 2021/0310773 | A1 | 10/2021 | Johnson et al. | |
| 2022/0252382 | A1 * | 8/2022 | Barrett | F42B 10/02 |
| 2023/0052273 | A1 | 2/2023 | Bjrkgren | |
| 2024/0210148 | A1 | 6/2024 | Gustafsson et al. | |
| 2024/0310155 | A1 * | 9/2024 | Thuvander | F42B 14/06 |
| 2024/0360742 | A1 | 10/2024 | Keyes et al. | |
| 2025/0146389 | A1 * | 5/2025 | Keyes | E21B 43/117 |

FOREIGN PATENT DOCUMENTS

| | | | |
|---|---|---|---|
| JP | 03-233300 | A | 10/1991 |
| WO | 2019/103780 | A1 | 5/2019 |

OTHER PUBLICATIONS

International Search Report and Written Opinion received for PCT Patent Application No. PCT/US2025/015692, mailed on Jun. 10, 2025, 13 pages.
International Search Report and Written Opinion received for PCT Patent Application No. PCT/US2025/015697, mailed on Jun. 9, 2025, 13 pages.

* cited by examiner

GROUNDING SABOT AND METHODS OF USE

TECHNOLOGICAL FIELD OF THE DISCLOSURE

One or more example embodiments disclosed herein are directed to projectiles and associated components such as may be employed in downhole perforation operations. More specifically, example embodiments comprise a grounding sabot, and a method for using the same.

BACKGROUND

Perforating is a process used to create holes in a well casing disposed in a wellbore. Perforation may be implemented using shaped charges. After perforation of the casing, and possibly the surrounding formation, fluids such as oil and gas may flow from the formation into the wellbore.

After perforating, hydraulic fracturing is employed to enhance the production of oil or gas. Fracturing may involve pumping fluid and proppant, such as sand, into the perforations in the well casing at high pressure to create fractures in the formation, which improves the permeability of the formation to the flow of gases and liquids from the formation into the wellbore.

Perforation guns are used in oil and gas well completion operations to create holes in the casing, cement, and formation, to enable hydrocarbons to flow into the wellbore. A disposable perforation gun tube is an element of the perforation gun assembly that carries the shaped charges that create the perforations.

While conventional perforation approaches have proven useful, the systems, devices, and methods for implementing perforation processes nonetheless leave room for improvement. For example, conventional approaches are relatively inefficient in terms of transferring forces resulting from propellant ignition to a projectile. As another example, the aerodynamic drag associated with conventional devices may reduce their velocity and, thus, the kinetic energy available for perforation.

BRIEF DESCRIPTION OF THE DRAWINGS

The appended drawings contain figures of various example embodiments to further illustrate and clarify the above and other aspects of example embodiments. It will be appreciated that these drawings depict only example embodiments and are not intended to limit the scope of this disclosure or of any claims. Example embodiments will be described and explained with additional specificity and detail through the use of the accompanying drawings.

ASPECTS OF SOME EXAMPLE EMBODIMENTS

Figure 1:
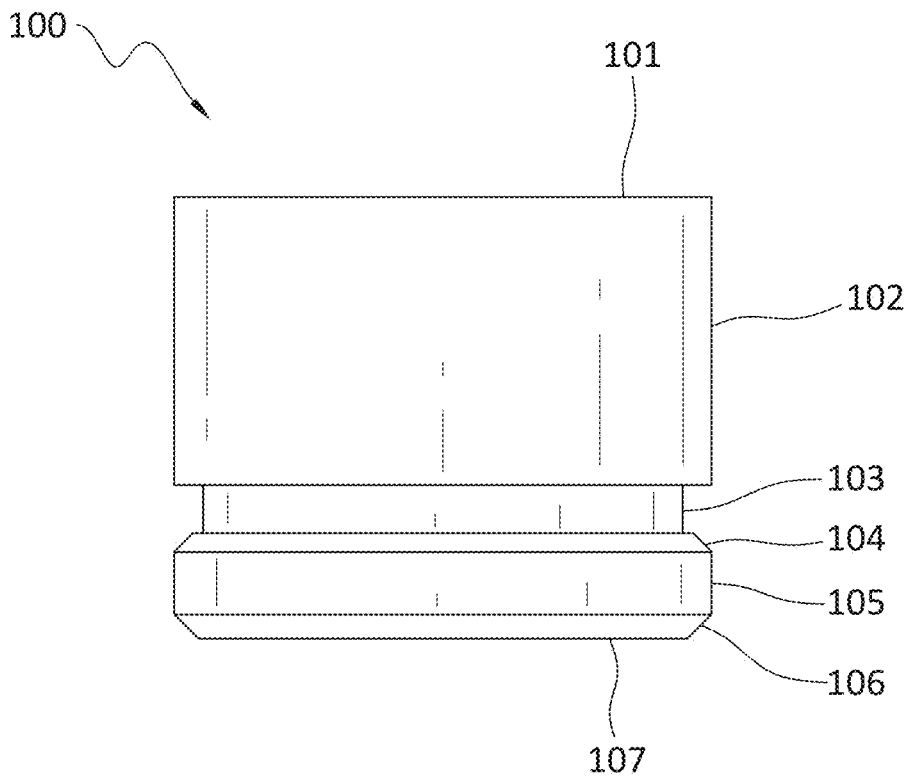
FIG. 1 is a side view of an example grounding sabot according to one embodiment.

One or more example embodiments disclosed herein are directed to projectiles and associated components such as may be employed in downhole perforation operations. More specifically, one or more example embodiments comprise a grounding sabot, associated devices and components, and a method for using the same.

Embodiments may be implemented in various ways. One embodiment comprises a grounding sabot, part or all of which may be electrically conductive, and/or which may include one or more electrically conductive components, that includes elements such as, but not limited to: a body configured to be partly received within a propellant chamber of a perf gun, wherein the body defines an interface by way of which the sabot is engageable with a projectile; a divider that defines part of the interface; an ignition pass through that extends through the divider; an ignition stack electrically connected to the ignition pass through; a ground terminal electrically connected to the ignition pass through; a deflector having a cup-shaped configuration that is partly defined by a bottom portion of the divider, and the deflector is configured to expand diametrically upon ignition of a propellant in the propellant chamber when the sabot is received within the propellant chamber; a gas valve configured and arranged to be actuated by expansion of the deflector; and, a compensator positioned between the interface and the gas valve.

Another embodiment comprises a jacket that may implement one, some, or all, of the same functions as a grounding sabot. As well, a jacket may comprise many, or all, of the same components as a grounding sabot. However, in contrast with a grounding sabot which engages a projectile, the jacket may be swaged to a projectile, such as a KEPR for example. For example, a jacket may comprise an electrically conductive terminal, such as a grounding terminal or other terminal, that enables an electrical component, wire, or any device requiring power and or communication signals, such as an ignition device for example, to electrically connect to the jacket. In an embodiment, this electrical connection comprises a grounding connection, or simply a 'ground.' Other example electrical connections that may be implemented by way of a jacket, or sabot, include, but are not limited to, an ignition signal connection, a control signal connection, and a sensor connection.

As will be apparent from this disclosure, example embodiments of the invention may be advantageous in various respects. For example, an embodiment may be more efficient, relative to conventional approaches, in transferring forces resulting from propellant ignition to a projectile. As another example, an embodiment may be associated with a reduced aerodynamic drag, relative to conventional devices, that may enable projectiles to achieve higher velocities, and kinetic energies which, in turn, may provide more effective and reliable perforations. Various other advantages of some embodiments of the invention will be apparent from this disclosure.

It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

DETAILED DISCUSSION

A. Context for One or More Embodiments—Methods and Processes

As noted earlier herein, embodiments may be employed in perforation processes in which a well casing, and possibly a formation within which the well casing is disposed, may be perforated using projectiles fired by a perforation gun. Following is a discussion of some considerations that may apply to one or more embodiments.

A.1 Purpose of Perforating the Casing

A well casing may be perforated for various reasons, one of which is reservoir access. In particular, a perforating a well casing may be performed to create channels or perforations in the well casing, enabling fluid communication between the reservoir and the wellbore. This enables hydrocarbons, for example, such as oil and gas, to flow from the reservoir into the wellbore, where they can be recovered. It is noted that as used herein, a 'fluid' embraces, gases, liquids, entrained particulates, and any combination of the foregoing.

A.2 Staged Approach to Perforating

One perforation process comprises a "plug-and-perf" method. In many hydraulic fracturing operations, a staged approach is employed using a plug-and-perf method. This involves perforating specific sections of the wellbore in stages, which may be isolated from each other by temporary isolation plugs that prevent the flow of fluids from one stage to another. In this approach, each stage corresponds to a specific depth interval in the well.

A.3 Plug-and-Perf Process

A.3.1 Staging

In preparation for a plug-and-perf process, various staging operations may be performed. These may included defining the number of stages, as well as various parameter values for the perforations. Staging operations may be useful for a variety of reasons. For example, staging enables more targeted and controlled access to different sections of a reservoir. This optimization may be important to enable maximization of hydrocarbon recovery and ensuring uniform production across the entire wellbore. As another example, staging operations may enhance In particular, a staged approach facilitates a more effective hydraulic fracturing process by isolating and treating specific reservoir intervals individually. This can lead to better fracture initiation and propagation.

The number of perforation stages may vary depending on factors such as the length of the horizontal well section, geological characteristics, and reservoir properties. Wells may have anywhere from a few to several dozen stages. The number of perforations per stage can also vary, and may depend on factors such as the desired production rate, reservoir characteristics, and the overall completion strategy. Each perforation creates a flow path for hydrocarbons to enter the wellbore during production.

A.3.2 Plug-and-Perf Processes

After staging has been completed, a plug-and-perf process may be performed. Such a process may comprise various operations. This process may begin with the drilling of the well. After the well has been drilled, a steel casing is installed and cemented in place to isolate and support the wellbore.

When the wellbore has been cased, a multistage perforation process may be performed in which the well is perforated in multiple stages. Each stage may comprise the following operations:

a. Setting an isolation plug—in this stage, a dissolvable or drillable isolation plug is set at a specific depth within the wellbore. This plug isolates the subsequent perforation zone from the previous ones.
b. Perforating—in this stage, perforating guns, equipped with shaped charges, are lowered into the wellbore opposite the targeted reservoir interval. The charges are fired, creating perforations in the casing and extending into the surrounding formation.
c. Repeating for each stage—the process of setting plugs, followed by perforating, is repeated for each designated stage.
d. Post-perforation clean-out and evaluation—after all of the stages are perforated, a workover rig such as a hydraulic workover or coiled tubing unit, may come in and drill out the remaining plugs in the well, clean/flush the wellbore of debris, and use a data collection system to ensure the effectiveness of the perforations and gather data on the wellbore conditions.

B. Context for One or More Embodiments—Shaped Charges

As discussed earlier herein, a conventional perf process may employ shaped charges. A shaped charge may comprise various components, each of which are addressed in turn below.

B.1 Liner

A liner is a metal cone or cylinder that is shaped in such a way that, upon detonation, it collapses and forms a high-velocity jet of molten metal. This jet is directed towards the target material, such as a casing, and a formation.

B.2 Case

The case contains the explosive material, such as RDX and or HMX, and provides structural support for the shaped charge. The case is typically made of a material that can withstand conditions in a downhole environment without a material effect on the functionality of the shaped charge.

B.3 Detonation Cord (Det Cord)

Det cord is a flexible explosive cord that surrounds the outside of the case. The det cord acts as the initiator and ensures that the explosive material in the case detonates uniformly and symmetrically.

B.4 Energetic and Explosives

Shaped charges are sometimes referred to as energetic devices because they convert stored chemical energy of an explosive into kinetic energy of a projectile or jet. The detonation of the explosive material creates a high-velocity metal jet that penetrates the casing and cement to create perforations.

B.5 Consumable Item

Upon detonation of an explosive, the shaped charge exerts extreme forces and temperatures. This leads to the destruction of the carrier and the tube, making them unsuitable for reuse. Thus, the use of a shaped charge is a one-time use process. That is, a shaped charge can only be used once.

C. Detailed Discussion of Aspects of One or More Embodiments

An example grounding sabot (GS) according to one embodiment is disclosed in FIGS. 1 through 6. Following are various considerations relating to one or more embodiments of a sabot.

C.1 Introduction

In an embodiment, a GS 100 may comprise a grounding terminal that enables an electrical component, wire, or device such as an ignition device to electrically ground to the GS 100. As collectively shown in the Figures, the GS 100 may comprise various components. These are each discussed in turn below.

An embodiment of the GS 100, as exemplified in FIG. 1, may comprise a body in the form of a single piece of material, such as metal. The body of the GS 100 may be created in various ways, such as, but not limited to, machining, additive manufacturing processes, casting, and molding.

In general, a GS, such as the GS 100, may help to optimize the performance of a KEPR (kinetic energy perforating round) (examples of which are disclosed in United States Utility Application), entitled KINETIC ENERGY PERFORATING ROUND AND METHODS OF USE, and filed the same day herewith) by one or more of the mechanisms discussed below.

In contrast with shaped charges, for example, an embodiment of the GS 100 may be reusable multiple times, in which multiple KEPRs or other projectiles are fired from the same GS 100. As such, in one embodiment, the GS 100 is not a consumable item.

C.1.1 Ensuring Efficient Transfer of Force From the Propellant

In an embodiment, the GS 100 may have a snug fit inside the barrel of a penetrating charge dispenser (PCD), which may be carried by a perf gun, that creates a seal that helps contain and channel the expanding gases produced by the ignition of propellant. By preventing, or mitigating, gas leakage around the KEPR, the GS 100 may ensure that the maximum amount of force generated by the propellant is directed toward accelerating the GS 100 and KEPR. As well, the GS 100 may minimize gas blowby by closely conforming to the shape of the KEPR and barrel. This containment of gases ensures that more energy is harnessed to propel the GS 100 and KEPR forward.

C.1.2 Enhancing the Kinetic Energy of the KEPR

In an embodiment, the GS 100 may help streamline the KEPR shape, reducing aerodynamic drag as the KEPR travels through the barrel of a perf gun. By minimizing, or at least reducing, air resistance, the GS 100 may enable the KEPR to maintain higher velocities and, thus, kinetic energies, as the KEPR exits the barrel. Further, since kinetic energy is proportional to the square of the velocity, even small increases in velocity result in a significant enhancement of kinetic energy.

C.1.3 Increasing Velocity of the KEPR

In an embodiment, the GS 100 facilitates efficient acceleration by ensuring that the force generated by the propellant is transmitted directly to the KEPR and GS 100. This efficient acceleration, coupled with the minimized air resistance provided by the GS 100, may result in a more rapid increase in velocity of the KEPR.

C.1.4 Non-Discarding Sabot

In an embodiment, the GS 100 may, but need not necessarily, comprise a non-discarding configuration and mode of operation. That is, a non-discarding GS 100 may remain attached to the KEPR, rather than being discarded or ejected, as the KEPR leaves the barrel. Put another way, unlike a discarding sabot, which may fall away, or be discarded, after it exits the muzzle of a barrel, a non-discarding GS 100 stays with the KEPR throughout the trajectory of the KEPR.

A sabot according to one embodiment, such as a non-discarding sabot for example, may contribute to an increase, relative to a circumstance where the sabot is not employed or where a conventional sabot is employed, in kinetic energy of the associated projectile. Kinetic energy (KE) is the energy an object possesses due to its motion. In the example context of a KEPR, increasing kinetic energy may enhance the perforating capabilities of the KEPR. The non-discarding GS 100 may play a role in this improvement in the kinetic energy of the KEPR by ensuring a tight fit of the GS 100 with the KEPR, and with the barrel of a penetrating charge dispenser from which the KEPR may be fired, reducing air resistance, and maximizing the transfer of energy from the propellant to the KEPR.

A sabot according to one embodiment may help to improve the velocity of a projectile, such as a KEPR for example. Velocity is a contributing factor to the kinetic energy of a KEPR. The non-discarding GS 100 may contribute to improved velocity of the KEPR by minimizing drag forces during as the KEPR travels through a barrel of a perf gun or other device.

A sabot according to one embodiment may improve, relative to a circumstance where the sabot is not employed or where a conventional sabot is employed, the work exerted on a projectile, such as KEPR for example. In this regards, 'work' is the product of force and displacement. In the context of a non-discarding GS 100, the force exerted by the expanding gases from the propellant is transmitted efficiently to the KEPR. The GS 100 assists in converting this force into acceleration of the KEPR, enabling the KEPR to achieve higher speeds. The work done on the KEPR may thus be maximized by an embodiment of a sabot, resulting in increased kinetic energy of the KEPR.

C.2 Discussion

With attention now to the examples of FIGS. 1 through 6, details are provided concerning aspects of example components of an example grounding sabot (GS), referenced in the Figures at 100, according to one embodiment. In an embodiment, the GS 100 may house, encase, or surround, a KEPR. In an embodiment, a jacket may be similar to a sabot except that the jacket may be swaged to the projectile. In an embodiment, a jacket may serve the same purpose(s) as a sabot.

As noted above, another embodiment comprises a jacket that may implement one, some, or all, of the same functions as a grounding sabot. As well, a jacket may comprise many, or all, of the same components as a grounding sabot. However, in contrast with a grounding sabot which engages a projectile, the jacket may be swaged to a projectile, such as a KEPR for example. For example, a jacket may comprise an electrically conductive terminal, such as a grounding terminal or other terminal, that enables an electrical component, wire, or any device requiring power and or communication signals, such as an ignition device for example, to electrically connect to the jacket. In an embodiment, this electrical connection comprises a grounding connection, or simply a 'ground.' Other example electrical connections that may be implemented by way of a jacket, or sabot, include, but are not limited to, an ignition signal connection, a control signal connection, and a sensor connection.

C.2.1 Apex

The apex 101 of the GS 100 is the upper most portion of the GS 100, or the top of the GS 100. As shown in the particular example of FIG. 4, the apex 101 may comprise an upper rim of a bearing surface 102.

C.2.2 Bearing Surface

A bearing surface 102 according to one embodiment may provide various functions. For example, the bearing surface 102 may be configured to conform closely to the outer profile of a KEPR. This precise fit may help to ensures that the GS 100 provides maximum support to the KEPR during acceleration of the KEPR through a barrel (see reference 119), discussed below.

A bearing surface 102 may serve as a sealing device within a gun barrel. It may create a gas-tight seal around the KEPR, preventing gas blowby, or the escape of high-pressure propellant gases around the KEPR. This sealing action may maximize the transfer of propellant energy to the KEPR, contributing to efficient acceleration of the KEPR.

In an embodiment, the bearing surface 102 may incorporate grooves, compensators, or drive bands that may capture gas that may be trying to blow by the GS 100 as it accelerates through the barrel 119. These features may enhance the overall performance and perforating capability of the KEPR.

In an embodiment, the bearing surface 102 may be configured to distribute the pressure generated by the propellant gases evenly across the contact area of the bearing surface 102 with a gun barrel. This distribution may help prevent localized wear and deformation, ensuring the GS 100 maintains its structural integrity throughout the firing process.

In an embodiment, as the GS 100 travels down a gun barrel, it may experience significant heat generated by the rapid combustion of propellant. The bearing surface 102 may be configured, and comprise material(s), to dissipate this heat efficiently and may prevent overheating and degradation of material properties of the GS 100. Heat-resistant materials and heat dissipation features contribute to maintenance of the GS 100 structural integrity, and examples of such materials include, but are not limited to, aluminum, titanium, copper, and brass.

In an embodiment, an outside diameter of the bearing surface 102 may closely match the inside diameter of a gun barrel. Such a precise fit may reduce the amount of surface area of the GS 100 that is in contact with a barrel, minimizing friction. That is, because the GS 100 may comprise aluminum or other relatively low friction material, and/or because the outside diameter of the GS 100 may be greater than that of the projectile, the bearing surface 102 may keep the projectile from touching the barrel. The material of the GS 100, with the additional surface contact, reduces the friction that may otherwise result if the projectile were to come into contact with the barrel 119. This may create a tight seal without unnecessary interference, enabling the GS 100, which may comprise aluminum and/or other material(s), to travel through the barrel with lower friction than if some other materials were used for the GS 100.

C.2.3 Compensator

In an embodiment, a compensator 103 may act as a sealing component within the GS 100, creating a gas-tight seal between the GS 100 and the KEPR. This seal may be useful in containing the high-pressure propellant gases behind the GS 100 and KEPR, preventing gas blowby past the KEPR and ensuring that the majority of the propellant energy is used to propel the GS 100 and KEPR forward.

By creating this gas-tight seal, the compensator 130 may minimize the escape of propellant gases around the GS 100. This may help to maximize the efficiency of the propulsion system, as any gas leakage results in energy loss of the KEPR and, correspondingly, reduced overall performance of the KEPR.

In an embodiment, the use of a compensator 103 in a non-discarding GS 100 may provide one or more advantages. For example, the compensator 103 may ensure that the propellant gases are effectively harnessed to drive the GS 100 and KEPR. By containing the gases and minimizing blowby, the compensator 103 may contribute to a more efficient transfer of energy from the propellant to the GS 100 and to the KEPR, leading to enhanced acceleration and velocity of the KEPR.

As another example, the compensator 103 may reduce fouling and wear within the gun barrel by containing the propellant gases and preventing direct contact between the GS 100 and the barrel. This may help in maintaining the longevity of the barrel and preserving the consistency of ballistic performance over multiple firings.

As another example, the compensator 103 may ensure a consistent and controlled environment for the GS 100 and KEPR, regardless of external conditions. By maintaining a secure seal, the compensator 103 may minimize the impact of factors such as temperature and pressure variations on the performance of the KEPR.

Yet another advantageous aspect of an example compensator 103 concerns the gas jetting that occurs when high-pressure gases escape unevenly around the GS 100 and KEPR, leading to asymmetrical forces that can affect performance of the assembly. The compensator 103 may minimize gas jetting effects by providing a uniform seal, promoting a more symmetrical and predictable flight path for a projectile.

In an embodiment, the compensator 103, by effectively containing and utilizing propellant gases, contributes to the optimization of kinetic energy. The enhanced acceleration and velocity achieved through proper gas sealing may result in higher kinetic energy upon impact, improving the ability of the KEPR to perforate multiple layers of confined target such as wellbore casing, cement, and formation.

C.2.4 Conducive Angle

In an embodiment, a conducive angle 104 on the body of the GS 100 may enable optimal expansion of propellant gases into the compensator 103. The angle, that is, the conducive angle 104, at which gases are channeled into the compensator 103 may be important for enhancing performance and mitigating potential issues such as flame gouging. In an embodiment, the conducive angle 104 may be in a range of 15 degrees to 100 degrees, inclusive.

In an embodiment, the conducive angle 104 may configured to facilitate the smooth and controlled flow of propellant gases into the compensator 103. This conducive angle 104 may be configured to minimize turbulence and resistance, ensuring that gases can efficiently fill the space within the compensator 103. For example, the conducive angle 104 may enable a gradual expansion of gases as they move from the confined space of the gun barrel 119 into the compensator 103. A gradual expansion helps maintain a controlled environment, reducing the likelihood of sudden pressure differentials that could impact the structural integrity of the GS 100 or the compensator 103.

The definition, configuration, and implementation, of the conducive angle 104 in the body of the GS 100 may be beneficial. For example, the conducive angle 104 may promote the efficient transfer of energy from the expanding gases to the GS 100. By enabling gases to fill the compensator 103 uniformly, the conducive angle 104 may help to ensure that the force generated by the propellant is evenly distributed, contributing to effective acceleration and velocity of the GS 100 and the KEPR.

As well, the conducive angle 104 may enable controlled gas expansion into the compensator 103 to help minimize gas blowby. This may be important for preventing the escape of high-pressure gases around the GS 100, which could result in energy loss and reduced overall performance. Further, an embodiment of the conducive angle 104 may contribute to creation and maintenance of a secure seal between the GS 100 and the barrel 119. The correct conducive angle 104 may help establish a gas-tight environment, optimizing the efficiency of the propulsion system. As noted below, the conducive angle 104 may help to mitigate various issues that can arise during the firing of a projectile that includes a GS 100.

For example, flame gouging is a phenomenon where hot propellant gases erode or damage the surfaces of the GS 100. In an embodiment, the conducive angle 104 may help mitigate flame gouging by directing gases in a way that minimizes direct impingement on surfaces. The conducive angle 104 may enable a more controlled interaction between gases and material surfaces, reducing the risk of erosion. As another example, an embodiment of the conducive angle 104 may play a role in regulating the temperature and pressure within the compensator 103. A conducive angle 104 may help prevent sudden spikes in pressure or temperature that could lead to adverse effects on the GS 100 or compensator 103 material, contributing to a more controlled and predictable environment.

C.2.5 Gas Valve

The configuration of an embodiment of a gas valve 105 may facilitate a balance between maintaining an initial seal for efficient energy transfer and enabling, in a controlled way, some gas to bypass the KEPR, contributing to optimal propulsion. An embodiment of a gas valve 105 with controlled gas bypass may have various characteristics.

For example, an embodiment of the gas valve 105 may be, or comprise, one or more gas channels 105*a* which may be sized and configured to enable controlled amounts of gas to flow over the conducive angle 104 and into the compensator 103. This configuration may help to ensure management of gas flow during the firing sequence. In an embodiment, the guides and/or channels may be circumferential.

As another example of an aspect of an example gas valve 105, rather than being a permanent, hermetic seal, the gas valve 105 may be configured to act as a controlled valve. This configuration may enable small amounts of gas to bypass the initial seal formed between the gas valve 105 and the barrel, typically over/past the conducive angle 104, and enter the compensator 103. The behavior of an embodiment of the gas valve 105 serves to capture as much energy, from propellant gases, as possible while maintaining stability of the GS 100 in flight. In more detail, the gas valve 105 may conform uniformly to the barrel, and allow gas to expand into the compensator 103. As the GS 100 travels up the barrel, the gas valve 105 may eventually seal and close off the barrel, thus capturing all of the gas while the compensator 103 captures the gas that has bypassed the gas valve 105.

In one embodiment, the controlled gas bypass enabled by the gas valve 105 may contribute to optimization of energy transfer from the propellant gases to the GS 100 and KEPR. By enabling gas flow over the conducive angle 104 in a controlled way, the configuration of the gas bypass 105 may capture additional energy that would otherwise be lost in a fully sealed system, maximizing the efficiency of the propulsion system. While allowing controlled gas bypass, the gas valve 105 may still maintain an effective initial seal, minimizing the risk of significant gas blowby past the KEPR and/or other components of the GS 100. This controlled bypass may balance the need for capturing energy with the requirement of preventing excessive gas leakage around the KEPR or other projectile.

In an embodiment, the valve-like behavior of the gas valve 105 provides dynamic adaptability to changing conditions during firing. It allows the system to adjust the amount of gas bypass based on factors such as pressure, temperature, and KEPR velocity, ensuring optimal performance across different scenarios. Moreover, controlled gas bypass helps mitigate the risk of flame gouging by allowing gases to flow in a regulated manner. This can prevent excessive heat and pressure from directly impinging on surfaces, reducing the likelihood of erosion or damage to the GS 100 or compensator 103. Finally, by allowing small amounts of gas to bypass over the conducive angle, an embodiment of the gas valve 105 may serve to enhance stability during its trajectory through the barrel. The controlled bypass helps manage asymmetrical forces and disturbances, contributing to a more predictable and stable trajectory of the KEPR.

C.2.6 Engagement Angle

An engagement angle 106, positioned below the gas valve 105, comprises a section of the outer diameter of the GS 100 that comes into contact with the propellant gases. This engagement angle 106 may be useful in initiating the controlled interaction between the GS 100 and the propellant gas, leading to efficient energy transfer and propulsion. In one embodiment, the engagement angle 106 may be in a range of 10 degrees to 50 degrees, inclusive.

In an embodiment, the engagement angle 106 is the first part of the outer diameter of the GS 100 that the propellant gases encounter, and the engagement angle 106 may be configured and arranged to be the primary point of contact where the gas begins to interact with the outer diameter of the GS 100. The engagement angle 106 may be configured to facilitate a controlled and gradual entry of gas into the gas valve. Its configuration ensures that gas flow commences in a manner that allows for efficient energy capture while maintaining stability.

In an embodiment, the engagement angle 106 plays a role in initiating the process of energy transfer from the propellant gases to the GS 100 and associated projectile. In particular, as propellant gases come into contact with the engagement angle 106, the controlled interaction begins, setting the stage for optimal energy capture and subsequent propulsion. As the initial point of contact with the propellant gases, an embodiment of the engagement angle 106 configuration enables a gradual expansion of gases. This configuration may ensure that the pressure buildup due to gas generation and expansion is controlled, contributing to a more stable and predictable acceleration of the GS 100 and KEPR.

Among other things, an embodiment of the engagement angle 106 may help to ensure controlled entry of gas into the gas valve 105, preventing sudden or uneven pressure differentials. This controlled environment contributes to stable propulsion and minimizes the risk of issues such as turbulence or erratic forces. Further, the configuration and arrangement of an embodiment of the engagement angle 106 may be optimized to minimize abrasion and wear as the gas begins to interact with the GS 100. This may be important for preserving the structural integrity of the GS 100 and maintaining consistent performance over multiple firings of one or more instances of a GS 100.

In an embodiment, the engagement angle 106 serves as a transitional zone that directs gas flow towards the gas valve. This ensures that the gas valve 105 operates effectively, capturing as much energy as possible while maintaining a degree of control over gas flow. As well, by guiding the initial interaction between the GS 100 and propellant gases, the engagement angle 106 contributes to the overall enhancement of propulsion, and optimizes the efficiency of the kinetic energy transfer process, leading to improved performance of the GS 100 and KEPR.

C.2.7 Base

The base 107 of the GS 100 is the bottommost section of the example GS 100. FIG. 1 discloses an example configuration and arrangement of a base 107 according to one embodiment.

C.2.8 KEPR Interface

Figure 2:
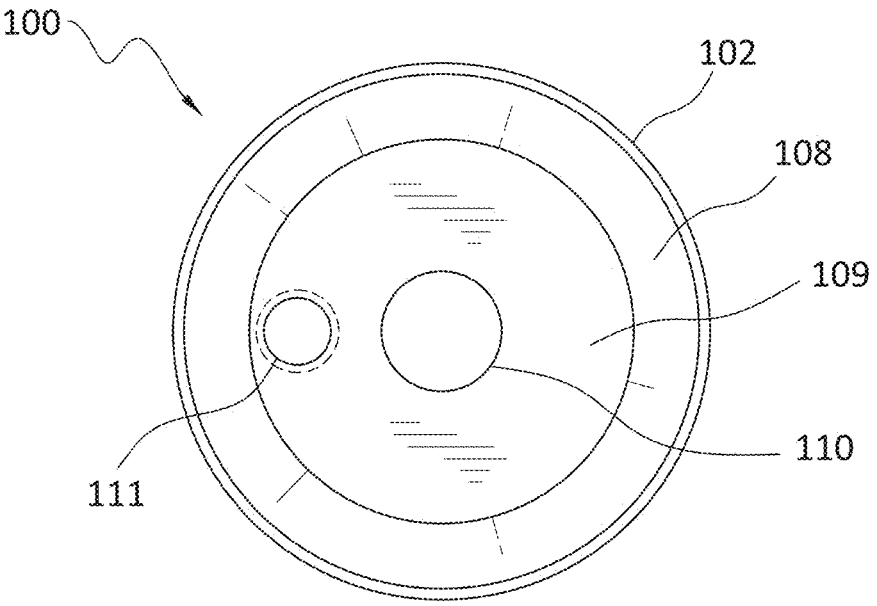
FIG. 2 is a top view of the example grounding sabot disclosed in FIG. 1.
Figure 3:
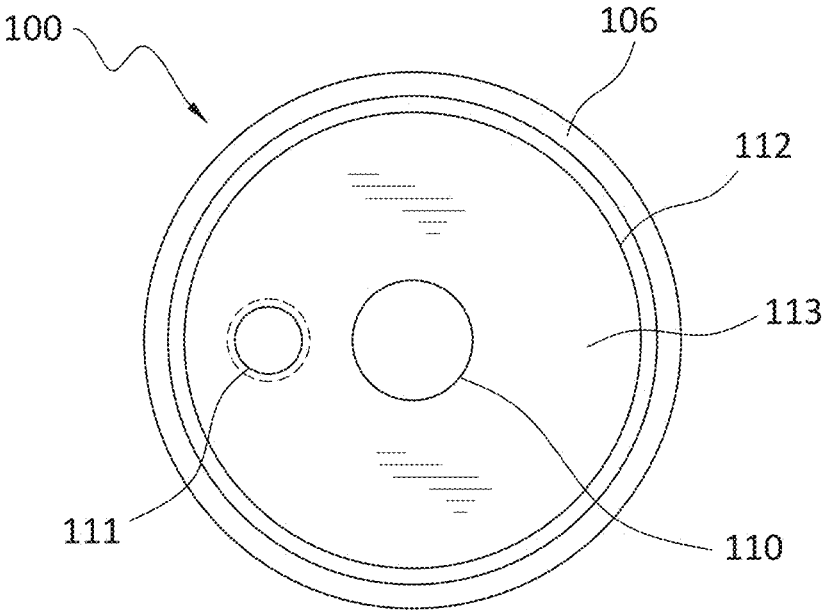
FIG. 3 is a bottom view of the example grounding sabot disclosed in FIG. 1.

In an embodiment, the interior wall of the GS 100, referred to as the KEPR interface 108, and shown in FIG. 2, directly interacts with the KEPR. As such, the KEPR interface 108 may play a role in ensuring stability, alignment, and efficient energy transfer during the KEPR firing sequence.

The KEPR interface 108 may be constructed from high-strength materials capable of withstanding the intense forces and pressures generated during the firing of the GS 100 and KEPR. Common materials include metals, alloys, or composite materials chosen for their durability and structural integrity. An embodiment of the KEPR interface 108 may be constructed using precision machining to achieve the desired dimensions and geometry. This machining may help to ensure a snug fit with the KEPR, minimizing play and maintaining alignment between the KEPR and the GS 100. In an embodiment, the KEPR interface 108 may be configured to conform closely to the outer profile of the KEPR. This close fit aids stability and may help to prevent any unnecessary movement or misalignment during the KEPR and GS 100 travel through the barrel 119 and upon exit. In one embodiment, the fit between the KEPR interface 108 and the outer profile of the KEPR may be an intentional negative press fit in a range of −0.001" to 0.010", inclusive.

In an embodiment, the KEPR interface 108 is configured to stabilize the KEPR within the GS 100. It prevents undesirable movements, rotations, or wobbling, ensuring that the KEPR maintains a consistent orientation during its entire trajectory. A precise interface between the KEPR interface 108 and a projectile helps in maintaining proper alignment between the GS 100 and the KEPR. This alignment helps in achieving accuracy and stability in flight, ultimately influencing the KEPR impact energy on the target.

An embodiment of the KEPR interface 108 may contribute to improved energy transfer from propellant gases to the GS 100 and projectile. For example, an embodiment of the KEPR interface 108 may facilitate the efficient transfer of energy from the GS 100 to the KEPR. During the firing sequence, the KEPR interface 108 ensures that the forces generated by the propellant are transmitted directly to the KEPR, contributing to effective acceleration. As well, a relatively close fit and precise interface between the KEPR interface 108 and KEPR minimize energy losses within the GS 100. By reducing play and maintaining a secure connection, the KEPR interface 108 may ensure that the maximum amount of energy generated by the propellant is transferred to the KEPR, maximizing the kinetic energy of the KEPR.

C.2.9 Divider Top

Figure 5:
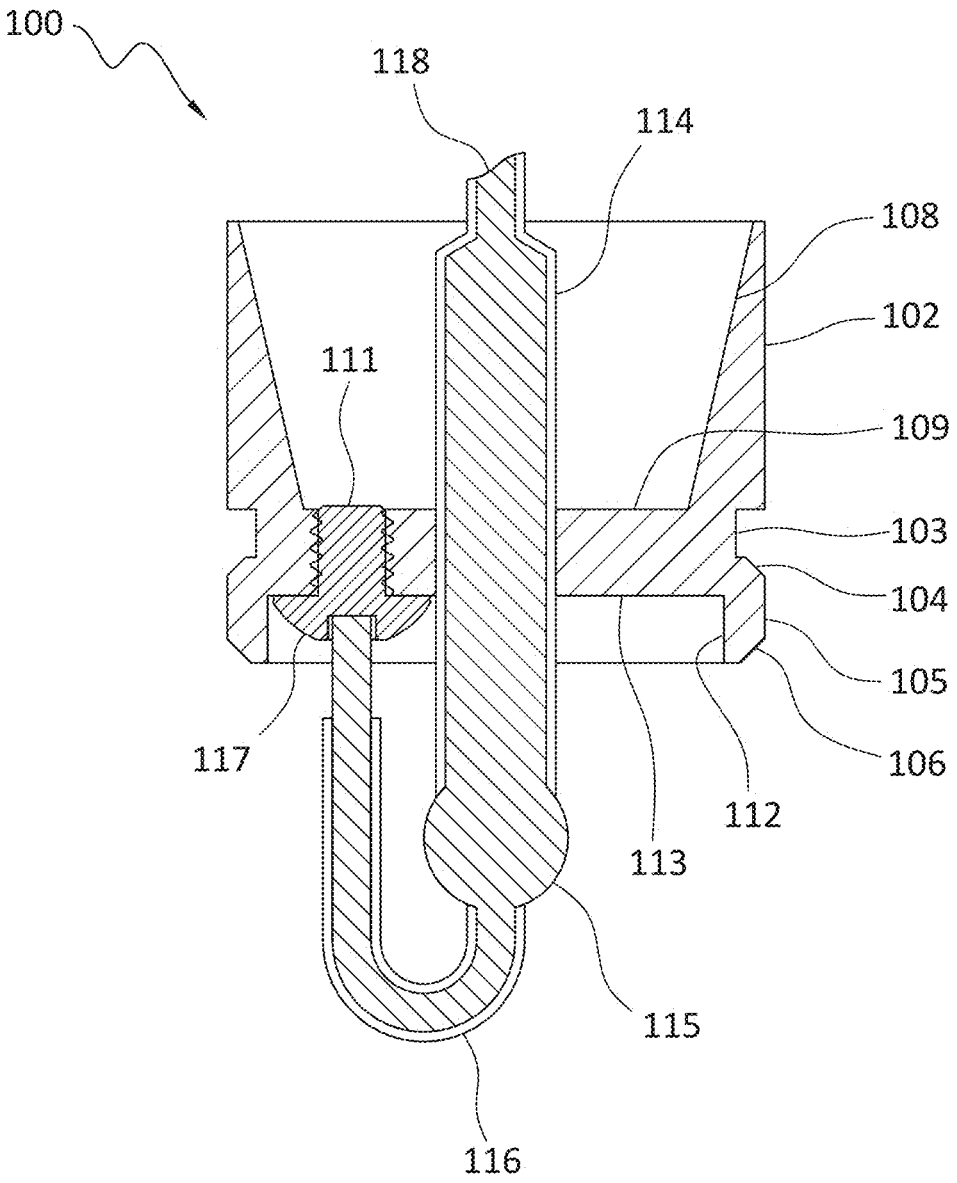
FIG. 5 is a side cross-sectional view of the example grounding sabot disclosed in FIG. 1.

In an embodiment, a divider top 109 may comprise a base plate that separates the KEPR from a propellant chamber (reference 121, discussed below). The divider top 109 may comprise two openings in the bottom through which a ground terminal (reference 111, discussed below) and an ignition pass through and/or ignition stack (reference 114, discussed below), respectively, may pass, as shown in the example of FIG. 5.

In an embodiment, the divider top 109 may be integral with the body of the GS 100 and, as such, may be constructed from materials chosen for their strength, durability, and ability to withstand the forces and pressures experienced during the firing sequence. Such materials include metals or alloys, with considerations for factors such as weight and structural integrity.

In an embodiment, the divider top 109 may comprise a flat and circular design, such as in the shape of a round disk for example. This geometry enables ease of manufacturing, uniform distribution of forces, and contributes to the overall energy capturing capabilities of the GS 100. In one embodiment, the divider top 109 may have a thickness of approximately 0.080 inches to 0.115 inches. This thickness may be selected to provide the necessary structural support for a KEPR and the elements of GS 100, while considering weight constraints and considerations One example function of an embodiment of the divider top 109 is to provide structural support to the KEPR system. Positioned between the KEPR and the propellant, the divider top 109 helps distribute and withstand the forces generated during the firing process, ensuring the integrity of the assembly that comprises the KEPR and GS 100. As well, the divider top 109 acts to isolate the KEPR and the propellant from each other. The divider top 109 may prevent direct contact between these components, maintaining the required configuration for efficient energy transfer during the KEPR acceleration.

In an embodiment, the divider top 109, along with other GS 100 components, contributes to creating a gas-tight seal within the GS 100. This seal may help in directing the propellant gases toward propelling the KEPR and GS 100 forward, minimizing gas blowby within the inside of the GS 100, and optimizing the efficiency of the propulsion system. By serving as a barrier between the KEPR and the propellant, the divider top 109 helps prevent gas leakage around the KEPR. This may be important for ensuring that the maximum amount of propellant energy is utilized for accelerating the KEPR.

In terms of its relation to the GS 100, an embodiment of the divider top 109 may be securely attached, as a separate and discrete component, to the GS 100, or manufactured as an integral element of the GS 100, forming a stable connection. The area of the divider top 109 that is integrated into the GS 100, or attached, may be configured to withstand the forces exerted during firing and to ensure that the divider top 109 remains in place throughout the KEPR travel through a barrel.

In an embodiment, the configuration of the divider top 109 is compatible with the configuration of the propellant. Particularly, an embodiment of the divider top 109 may help to ensure that the propellant gases are directed efficiently toward the GS 100 while maintaining the necessary structural considerations. A thickness of the divider top 109 may be such as to balance structural strength with weight considerations. This optimization ensures that the KEPR achieves the desired performance characteristics without unnecessary weight penalties.

C.2.10 Ignition Pass Through

In an embodiment, the GS 100 comprises an ignition pass through 110, which may be in the form of a hole or opening, that may serve as a pass through for an ignition stack or ignition device that may be located in the center of the GS 100. The ignition pass through 110 may comprise materials suitable for conducting electrical current safely and reliably. Possible materials include metals with good electrical conductivity.

With regard to its configuration, the example ignition pass through 110 may comprise a conductive rod or hole that extends through the bottom of the divider top divider 109 and into the propellant chamber (reference 121, discussed below. The ignition pass through 110 configuration helps to ensure a secure connection and pass through for an ignition device or ignition stack (reference 114, discussed below).

In an embodiment, the portion of the ignition pass through 110 that passes through, and possibly contacts, the divider top 109 may be insulated to prevent unintended electrical contact and electrical current conduction with the surrounding GS 100 components. This insulation may help maintain electrical integrity and ensures that ignition is initiated only when intended or by eliminating potential intermittence or grounding of the ignition device or ignition stack.

Figure 6:
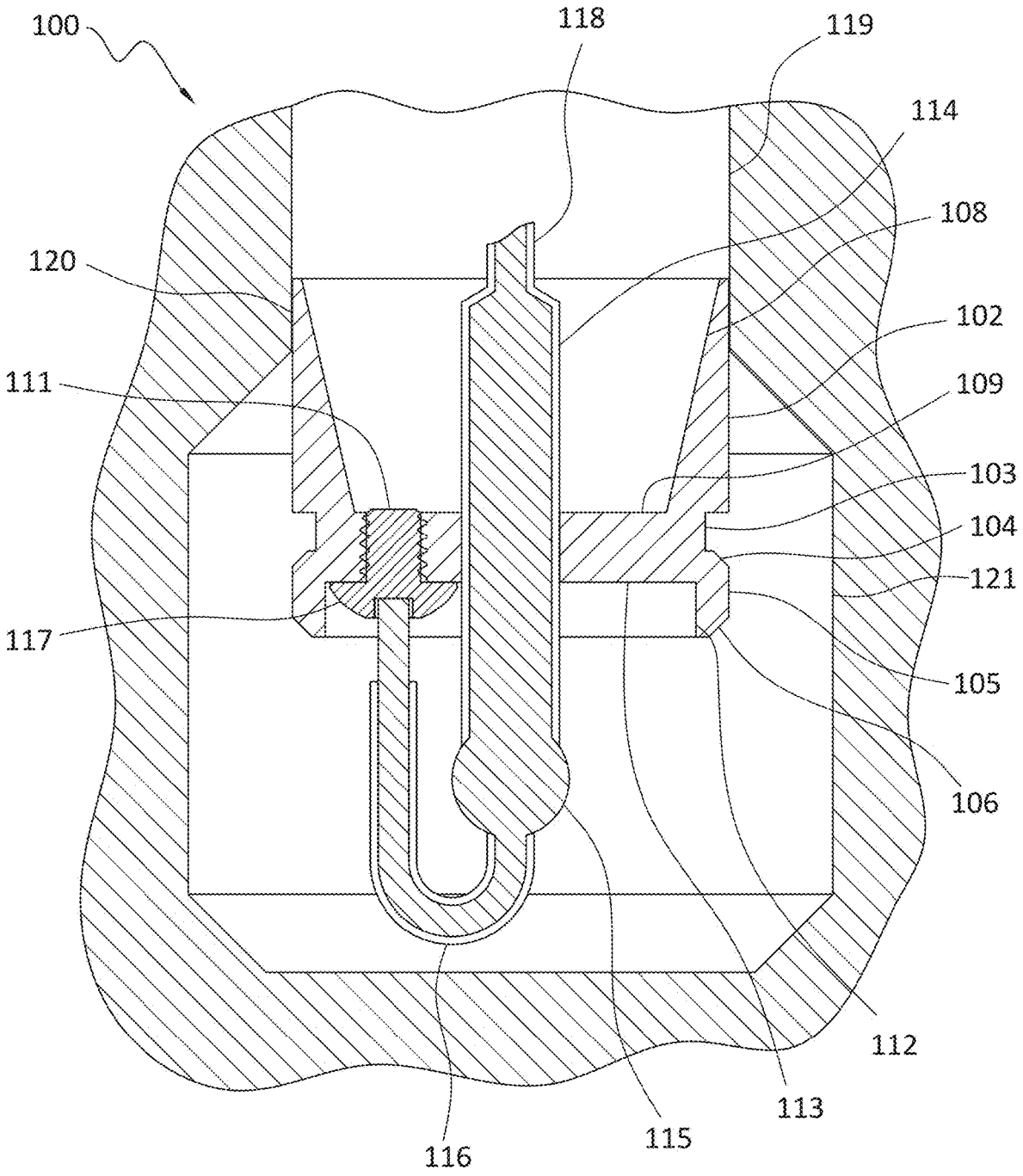
FIG. 6 is a side cross-sectional view of the example grounding sabot disclosed to FIG. 1, chambered in a device such as a perf gun.
Figure 7:
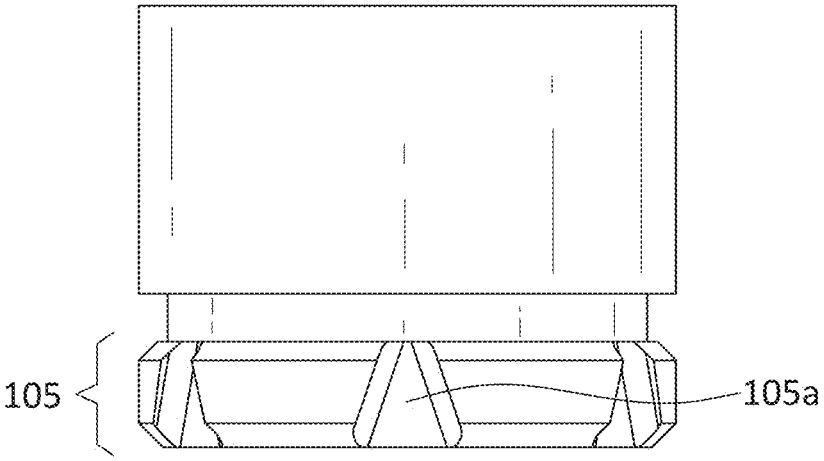
FIG. 7 is a side view of the gas channels of a grounding sabot according to one embodiment.
Figure 8:
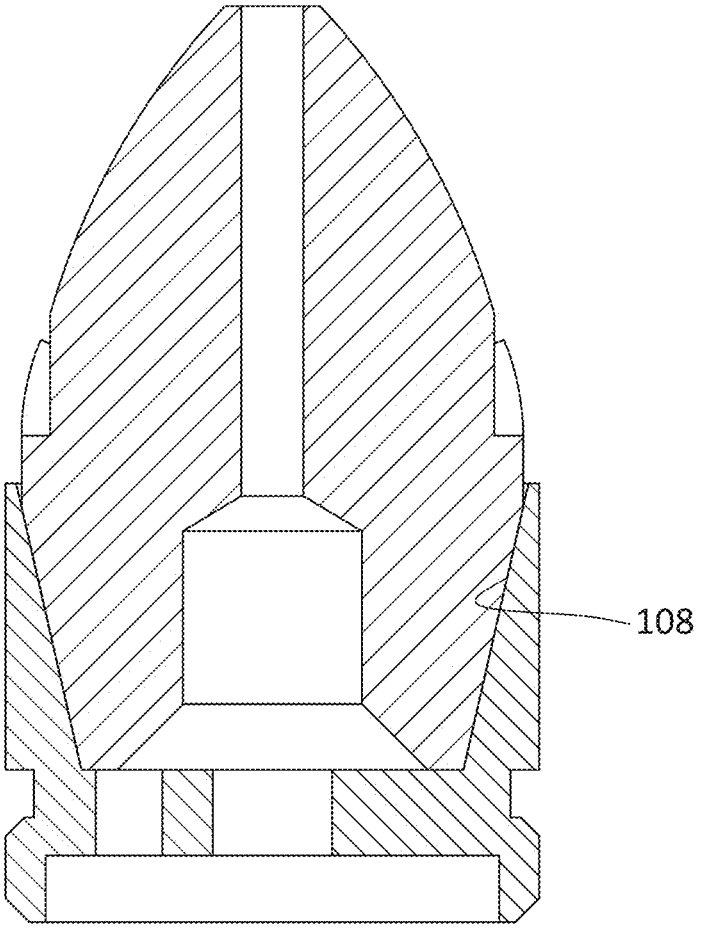
FIG. 8 is a side view of an interface of a grounding sabot, according to one embodiment, with a kinetic energy perforating round (KEPR).

With regard to some example functionalities, an embodiment of the ignition pass through 110 serves as the pathway, and or housing, for an ignition device or ignition stack that may be used to initiate the ignition of the propellant. Thus, the ignition pass through 110 may be configured to house, or enable pass through of, an internal ignition system, such as an electrical firing mechanism, or ignition device. As best shown in FIG. 6, the ignition pass through 110 extends into the propellant chamber (reference 121, discussed below) and/or through to the bottom of the divider top 109, ensuring that the electrical energy is delivered through the GS 100 and directly to the propellant. This integration may be important for achieving consistent and reliable ignition, as the energy is applied at the point where it is needed for propelling the KEPR.

An embodiment of the ignition pass through 110 may comprise various safety features. For example, the portion of the ignition pass through 110 passing through the divider top 109 may be insulated to prevent unintended electrical contact with other components. This insulation enhances safety by minimizing the risk of electrical discharge before intentional ignition. As another example, the ignition pass through 110 may be defined in the divider top 109 and may be situated in the center of the divider top 109, to ensure stability and reliable electrical connection. This arrangement is configured to withstand the forces and vibrations experienced during the firing sequence.

In an embodiment, the ignition pass through 110 may be positioned in or near the center of the GS 100 or in a location, passing through the divider top 109, that may enable an ignition device to deliver electrical energy directly into the propellant chamber 121, ensuring that ignition occurs in the proper location of the propellant charge. This location of the ignition pass through 110 helps to maximize the effectiveness of the GS 100. In an embodiment, the configuration of the example ignition pass through 110 takes into account the configuration of the propellant chamber 121, and also ensures that the ignition pass through 110 is appropriately positioned to allow an ignition device to initiate ignition in a manner that optimally utilizes the propellant energy for accelerating the KEPR.

C.2.11 Ground Terminal

A ground terminal 111, which may be offset to the ignition pass through, plays a role in providing a pathway for electrical grounding within the GS 100 assembly. In an embodiment, the ground terminal 111 ensures a controlled and safe discharge of electrical energy, contributing to the overall safety and reliability of the ignition system.

In one embodiment, the ground terminal 111 is positioned at a distinct location, separate, and spaced apart, from the ignition pass through 110. Similar to the ignition pass through 110, an embodiment of the ground terminal 111 may be made of conductive materials with good electrical conductivity, so as to ensure a reliable pathway for grounding and/or passing electrical current. The ground terminal 111 may comprise a pass through for a grounding device, extending, or passing through, from a specific point in the GS 100 assembly to facilitate the grounding function. The configuration of the ground terminal 111 provides stability, reliability, and ease of integration within the overall assembly.

In one embodiment, a primary function of the ground terminal 111 is to provide a designated pathway for grounding the ignition system. This helps to ensure the safe and controlled discharge of electrical energy during the firing sequence. The offset position, as shown in FIG. 2, of the ground terminal 111, relative to the ignition pass through 110, may ensure that a grounding process facilitated by the ground terminal 111 is electrically isolated from, and unaffected by, the ignition process facilitated by the ignition pass through 110. This intentional separation prevents unintentional grounding and contributes to the overall safety of the system.

An embodiment of a ground terminal 111 may provide various safety features. For example, an embodiment may prevent unintended discharge of electrical energy. The offset configuration between the ground terminal 111 and the ignition pass through 110 ensures that grounding occurs only when intentionally initiated, reducing the risk of accidental activation. In an embodiment, the ground terminal 111 may comprise insulation or isolation features to prevent unwanted electrical contact/communication with other selected components. This feature further enhances safety by minimizing the potential for electrical discharge in unintended areas of the GS 100 assembly.

As suggested above, a ground terminal 111 may be integrated with an ignition system. For example, an embodiment of the ground terminal 111 is configured to connect to an external grounding system or component, or to enable the transfer of electric current from the GS 100 and through the barrel 119 to ground. This connection ensures that the electrical current is safely discharged to the ground, completing the circuit and preventing the accumulation of charge. In one embodiment, the configuration of the ground terminal 111 takes into account the configuration of the ignition device. It ensures compatibility and effective integration to establish a reliable grounding pathway from the GS 100, to the barrel, and to ground as part of the overall ignition system.

With regard to safety considerations, the ground terminal 111 may be securely attached to the GS 100 assembly, ensuring stability and reliability. This attachment is configured to withstand the forces and vibrations experienced during the firing sequence.

Finally, in an embodiment, the ground terminal 111 may incorporate redundancy features to ensure the reliability of the grounding system. For example, the ground terminal 111 may comprise multiple ground terminals or backup mechanisms to guarantee a consistent and fail-safe grounding process.

C.2.12 Deflector

As best shown in FIGS. 5 and 6, deflector 112, situated at the bottom of the GS 100, is a component of the GS 100 that may optimize the capture of energy generated during the firing of the GS 100 and KEPR system. The configuration of the deflector 112 may enable it to deflect outward and conform to the barrel 119, ensuring efficient utilization of propellant energy. In particular, the gas pressure expands the deflector 112 outward and conforms the deflector 112 to the ID (internal diameter) of the barrel. This element captures the gas in the cup shape of the bottom of the GS 100. The deflector 112 may be analogous to the walls of the cup and the gas is forcing the deflector 112 outwards towards the ID of the barrel 119.

With regard to some of its example physical characteristics, an embodiment of the deflector 112 may be made from materials known for their durability, heat resistance, and ability to withstand the forces generated during the firing sequence. Such materials include metals or alloys capable of maintaining structural integrity under high pressures and temperatures. In one embodiment, the deflector 112 is integral with the GS 100, and has a configuration resembling an upside down cup with a wall that is located at the bottom of the GS 100. The deflector 112 is positioned to interact with the propellant gases and contribute to the overall efficiency of the propulsion system. In an embodiment, the deflector 112 comprises a shape that enables it to conform to the interior shape of the gun barrel 119. This conforming configuration may help in maximizing the capture of propellant energy by directing gases in a controlled manner.

An embodiment of the deflector 112 may be configured to deflect, or flex, outward, such as under the influence of the temperature and pressure of the gas, during a firing sequence. This outward deflection that may optimize the interaction, such as by increasing the contact area, between the GS 100 and the gun barrel 119, ensuring that propellant gases are efficiently captured. By conforming to a barrel for example, the deflector 112 maximizes the transfer of energy from the propellant gases to the GS 100. This configuration of the deflector 112 contributes to enhanced acceleration and velocity of the GS 100 and KEPR by capturing as much energy as possible during the initial phase of propulsion.

In an embodiment, the deflector 112 guides the propellant gases in a controlled manner as they expand within the cup-like structure of the deflector 112. This controlled gas flow may be helpful in preventing turbulence and ensuring that energy is efficiently transferred to the GS 100. Further, the conforming, or conformable, shape and configuration of the deflector 112 enhances the efficiency of the gas-to-GS 100 energy transfer, and may also help create a more directed and focused flow of propellant gases, reducing energy losses and optimizing the overall performance of the GS 100.

An embodiment of the deflector 112 may lend a degree of stability to the GS 100. For example, the deflector 112 maintains structural integrity during the outward deflection. This stability may ensure that the GS 100 remains intact and that the deflector 112 effectively channels the energy without compromising the overall structural integrity of the assembly that comprises the KEPR and GS 100.

In an embodiment, the configuration of the deflector 112 takes into account its compatibility with other GS 100 components, such as the divider bottom (reference 113, discussed below) and gas valve 105. This ensures a cohesive interaction between components and contributes to the stability of the entire system.

An embodiment of the deflector 112 may be heat and abrasion resistant. For example, the deflector 112 may comprise elements such as heat-resistant coatings or materials to withstand the high temperatures generated during the firing process. Additionally, abrasion-resistant properties help maintain the longevity of the deflector 112 under repeated use. Example abrasion-resistant materials and coatings include PTFE (polytetrafluoroethylene) coatings, polymer and plastic coatings, anodization, and electroless nickel.

Finally, while able to deflect outwardly, the deflector 112 may also contribute to implementing and maintaining an initial gas seal to close the gas valve 105 by deflecting outward and forcing the gas valve closer to the gun barrel 119 wall. This is useful in preventing gas blowby and ensuring that the expanding propellant gases are directed toward the KEPR.

C.2.13—Divider Bottom

In an embodiment, and as shown in FIGS. 5 and 6 for example, a divider bottom 113 disposed opposite the divider top 109. That is, the divider top 109 and divider bottom 113 may comprise respective opposing faces of a divider.

Thus, the divider bottom 113 may be located at the base of the GS 100 assembly, situated beneath the KEPR and forming the lower part of the GS 100. As one of the initial components exposed to the ignited propellant gases, the divider bottom 113 helps in capturing and directing these gases to drive the propulsion system.

As with all of the other elements of the GS 100 body, the divider bottom 113 may be an integral element of the GS 100 body which, as noted elsewhere herein, may comprise a single piece of material. More particularly, an embodiment of the divider bottom 113 may be formed as an integral part of the GS 100, forming a lower section that interacts directly with the ignited propellant gases.

Accordingly, an embodiment of the divider bottom 113 may comprise robust and heat-resistant materials to withstand the high pressures and temperatures generated during the firing sequence. Such materials include metals or alloys chosen for their durability and stability under extreme conditions. As well, the divider bottom 113 may be configured to maintain structural rigidity under the significant forces experienced during firing. This stability may enable the divider bottom 113 to withstand the pressure generated by the propellant, that is, the propellant gases that result from ignition of the propellant, and to provide a reliable foundation for the entire GS 100 assembly.

In one embodiment, a role of the divider bottom 113 is to capture the propellant gases and channel them in a controlled manner. As one of the first components exposed to the expanding gases, the divider bottom 113 plays a role in initiating the propulsion process. For example, by capturing and directing the propellant gases, the divider bottom 113 contributes to the efficient transfer of energy from the propellant to the GS 100 so as to propel the KEPR with optimal velocity.

To this end, an embodiment of the divider bottom 113 is configured to confine and direct the propellant gases in a way that optimizes energy transfer. The shape and configuration of the example divider bottom 113 may help create a controlled environment within the GS 100, guiding the gases toward the desired path, that is, toward the KEPR or other projectile. In an embodiment, the divider bottom 113 contributes to enhancing gas pressure within the GS 100 assembly. Particularly, by capturing and confining the gases, an embodiment aids in creating a high-pressure environment that drives a projectile.

In addition to aiding with control of gas flow, the divider bottom 113 may provide support for a projectile. In one embodiment, for example, the divider bottom 113 is connected to the divider top 109 to form an integral unit, that is, a divider, that supports and secures the KEPR. This integration may ensure that the entire GS 100 assembly functions as a unified system during the firing sequence. The interface between the divider bottom 113 and other components, such as the divider top 109 and deflector 112 walls, is configured to enable creation of a gas-tight seal during firing of a projectile. This seal may prevent gas blowby and may ensure that the expanding propellant gases are directed effectively for propulsion of the projectile. A well, the configuration of the divider bottom 113 may minimize energy loss by maintaining a tight seal and directing the propellant gases with efficiency. This contributes to optimization of the overall performance of the GS 100 and KEPR system.

C.2.14 Ignition Stack

Figure 4:
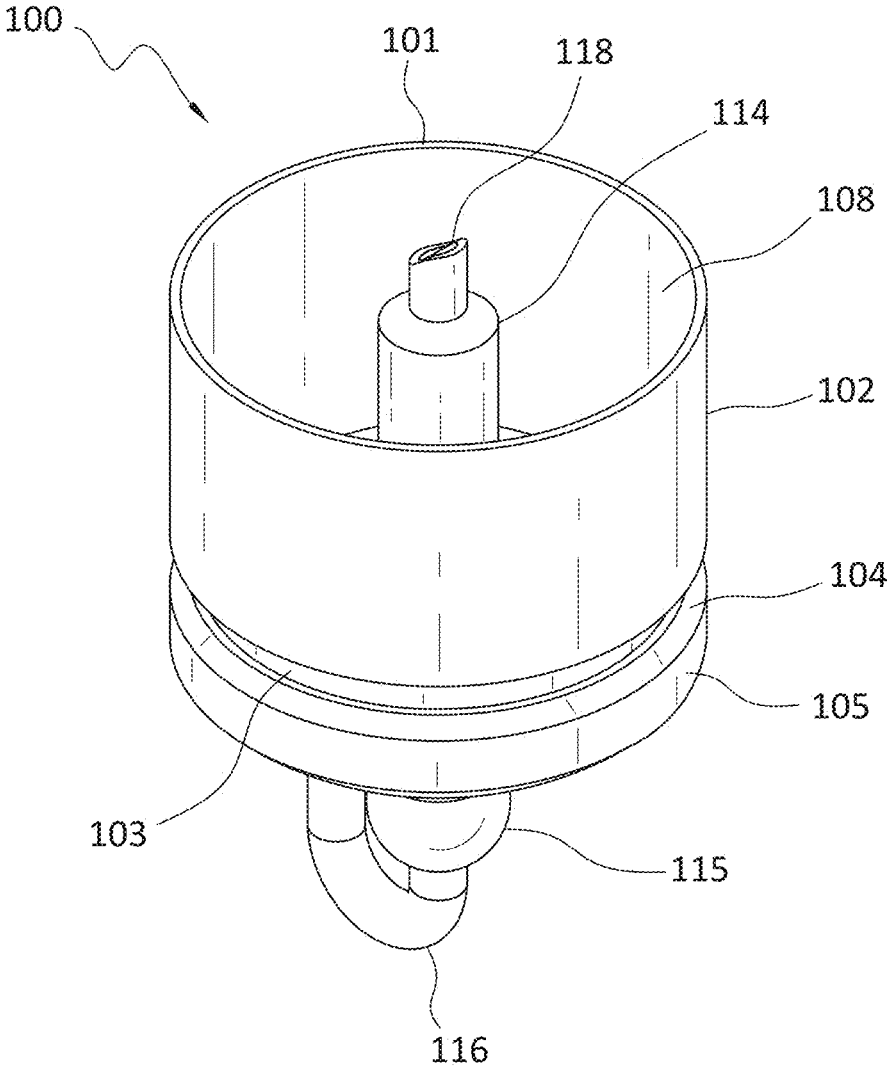
FIG. 4 is an isometric view of the example grounding sabot disclosed in FIG. 1, and further including an ignition device.

As best shown in FIGS. 4 and 5, an ignition stack 114 passes electrical current, for ignition of a propellant, from an external source through the GS 100 assembly and to the ignition pass through 110. The ignition stack 114, passing through the ignition pass through 110, divider top 109, and divider bottom 113, serves to deliver the necessary electrical current to the ignitor 115 located in the propellant chamber 121.

In an embodiment, the ignition stack 114 may comprise a stacked configuration. Thus, an ignition stack 114 may comprise multiple components stacked together to form a continuous electrically conductive pathway from the external ignition source, and electrical contact that may be connected to an ignition source, to the ignitor 115 within the propellant chamber 121. In an embodiment, the ignition stack 114 may incorporate insulation at certain points to prevent unintended electrical contact with surrounding GS 100 components and the KEPR. In one embodiment, a function of the ignition stack 114 is to act as a conduit for transmitting electrical current from an external ignition source to the ignitor 115 within the propellant chamber 121. It facilitates the controlled transfer of energy to initiate the ignition of the propellant.

In an embodiment, the ignition stack 114 is configured to mate with the ignition pass through 110, ensuring a secure electrical connection. In particular, an uppermost part of the ignition stack 114 extends through the divider top 109, maintaining continuity and connection to the external ignition source. The ignition stack 114 then passes through the divider bottom 113, extending into the propellant chamber 121.

The ignition stack 114 may be configured for proper alignment and stability as it passes through the divider top 109 and divider bottom 113. That is, alignment of the ignition stack 114 to the center of the GS 100 may be important as such alignment may center the ignition point of the ignitor (reference 115, discussed below) with the propellant. In an embodiment, it may be important that the propellant is ignited in the correct location in the propellant chamber.

As shown, for example, in FIG. 6, the ignition stack 114 terminates at the ignitor 115 within the propellant chamber 121. The interface between the ignition stack 114 and the ignitor 115 may ensure a secure and efficient connection for the initiation of the propellant ignition. The ignition stack 114 may be securely attached to the ignitor 115, such as by welding or brazing for example, to withstand the forces and vibrations experienced during a firing sequence. This secure attachment may help to maintain the integrity of the ignition system.

An embodiment of the ignition stack 114 may comprise insulation within the ignition stack 114 to enhance safety and avoid inadvertent electrical contact between components. This insulation prevents unintended electrical contact with other GS 100 components, minimizing the risk of accidental discharges. As well, an embodiment of the ignition stack 114 may incorporate features that facilitate controlled energy, that is, electrical current, transfer to the ignitor 115. This ensures that ignition occurs only when intended, reducing the likelihood of premature or unintended firing.

In an embodiment, an uppermost part of the ignition stack 114 is configured to connect to an external ignition system, or may have an electrical contact that may connect to an electrical firing mechanism. This connection allows for a controlled and deliberate initiation of a projectile firing process. In an embodiment, the ignition stack 114 may be adaptable for use with different ignition systems, ignitors, ignition components, and external energy sources. This adaptability contributes to the versatility and reliability of the overall ignition process.

C.2.15 Ignitor

As shown in the example of FIGS. 4, 5 and 6, an ignitor 115 may comprise a device that ignites the propellant in the propellant chamber. Ignitor plugs are one example embodiment of an ignitor 115 that may be used to initiate the combustion of propellants. Ignitor plugs may comprise a pyrotechnic composition or an electrically heated element. An ignitor 115 may comprise a hot-wire ignitors that may include a resistive wire that heats up rapidly when an electric current passes through it. This heated wire, in turn, ignites the propellant. In still another example, an ignitor 115 may comprise pyrotechnic initiators which may take the form of small devices containing pyrotechnic compositions that generate intense heat or flame when ignited. Such a pyrotechnic initiator may be used to initiate a chain reaction leading to propellant ignition. Various other embodiments of an ignitor 115 are possible as well.

For example, an ignitor 115 may comprise squibs and detonators which are explosive devices that produce a shockwave or heat capable of igniting propellants. An ignitor 115 may comprise an ignition cartridge that is a self-contained unit that may include both an ignition source and the necessary propellant for initiating combustion. An ignitor 115 may comprise a hypergolic ignition systems. Hypergolic propellants spontaneously ignite upon contact with each other. Hypergolic ignition systems may use this specific property to eliminate the need for a separate ignition device, relying on the inherent reactivity of the propellants. In another embodiment, an ignitor 115 may comprise a laser ignition system that may use a high-energy laser to ignite propellants. In one example, a laser beam is focused on a specific point to initiate combustion of a propellant. As a final example, an ignitor 115 may comprise an electrically ignited initiator that may use electrical current to generate heat or sparks, initiating the combustion of propellants. Such ignitors may include resistive elements or spark-gap designs.

C.2.16 Ground Wire

As best shown in FIGS. 4, 5 and 6, an embodiment of a GS 100 may comprise a ground wire 116. In an embodiment, ground wire 116 may comprise an insulated wire that comes off of the ignitor 115 and connects to the GS 100 at the ground terminal 111. The outer layer of the ground wire 116 may be insulated to prevent unintended contact with other components, the propellant, and or surfaces. This insulation may be necessary for maintaining electrical integrity and preventing short circuits or unintentional grounding. The end of the ground wire 116 may be equipped with a ground terminal contact that securely attaches to the GS 100 at the ground terminal 111, or another grounding point within the assembly.

In one embodiment, a function of the ground wire 116 is to provide an electrically conductive pathway for the safe discharge of electrical energy from the ignitor 115. By grounding the ignitor 115, the ground wire 116 completes the electrical circuit, allowing controlled energy transfer during the ignition process. As well, the ground wire 116 may serve as a safety mechanism by providing a designated and controlled path for electrical discharge. This helps prevent unintended electrical events, contributing to the overall safety of the GS 100.

In an embodiment, the ground wire 116 connects to the ground terminal 111 within the GS 100 assembly. This connection ensures that the electrical current is safely discharged to the ground, completing the circuit. The connection point of the ground wire 116 is securely attached to the designated ground terminal 111, ensuring reliable contact to ground.

In an embodiment, insulation on the ground wire 116 prevents unintended contact with other components, surfaces, or conductive materials. This protective layer minimizes the risk of electrical interference and helps maintain a safe operating environment. An embodiment of the ground wire 116 may be robust and durable, capable of withstanding the forces and vibrations experienced during a firing sequence. Its robust configuration ensures that the wire remains intact and functional under various conditions.

The ground wire 116 may be adaptable to different ignitor 115 configurations. Its configuration and arrangement enables compatibility with various types of ignitors used in GS 100 and KEPR systems. Further, the ground wire 116 is versatile in its ability to connect to different grounding points within the GS 100 assembly. This versatility allows for flexibility in the overall design of the ignition and grounding system.

C.2.17 Ground Terminal Contact

As shown in the examples of FIGS. 5 and 6, an embodiment of a GS 100 may include ground terminal contact 117 that may establish a secure and reliable electrical connection between the ground wire 116 and the GS 100, specifically, at the ground terminal 111. In an embodiment, this contact is necessary for completing the electrical circuit and providing a controlled pathway for the discharge of electrical energy, contributing to the safety and reliability of the GS 100 and KEPR system. In an embodiment, the ground terminal contact 117 may comprise a machine screw or similar fastener, but need not take any particular form or configuration.

An embodiment of the ground terminal contact 117 comprises an electrical connector, such as a fastener for example, that securely mates with the ground terminal 111 on the GS 100. The configuration and arrangement of the ground terminal contact 117 may ensure a snug and stable connection with the ground terminal 111, preventing unintended disconnection during the firing sequence. The contact surface of the ground terminal contact 117 is configured to maximize contact area and conductivity, such as a threaded contact for example. The ground terminal contact 117 may help to reduce electrical resistance and ensure efficient energy transfer, that is, electrical current, between the ground wire and the GS 100.

In the ignition system, the ground terminal contact 117 is the point at which the ground wire from the ignitor 115 connects to the GS 100 assembly. This connection completes the electrical circuit and establishes a pathway for the safe discharge of electrical energy. The ground terminal contact 117 serves as a grounding mechanism by providing a designated point for the controlled discharge of electrical energy. This contributes to the safety and reliability of the GS 100 and KEPR system during the ignition process.

In more detail, with respect to the interface between the ground terminal contact 117 and the GS 100, connector of the ground terminal contact 117 securely attaches to the ground terminal 111 on the GS 100. This attachment may provide stability and reliability, ensuring that the connection remains intact under the forces and vibrations experienced during firing. The configuration of the ground terminal contact 117 accommodates the specific configuration of the ground terminal 111 on the GS 100. This compatibility ensures that the ground terminal contact 117 aligns correctly, establishing a proper electrical connection.

The ground terminal contact 117 may comprise various safety features. For example, the ground terminal contact 117 may comprise a secure locking mechanism, such as a fastener for example, to prevent unintended disconnection. This feature enhances safety by ensuring that the connection remains stable and reliable throughout the firing sequence. Also, while the ground terminal contact 117 comprises an electrical conductor, it may include features to minimize unintentional contact with other conductive components, reducing the risk of electrical interference or short circuits.

The ground terminal contact 117 is adaptable to different ground wire configurations. This adaptability allows for compatibility with various ignitors and grounding systems used in GS 100 and KEPR assemblies. Further, the configuration of the ground terminal contact 117 considers the variability in ground terminal designs among different GS 100 assemblies. This versatility ensures that the ground terminal contact 117 can be effectively used with various GS 100 configurations.

Depending on the materials used, the ground terminal contact 117 may comprise corrosion-resistant coatings or features to maintain its functionality over time, especially in challenging environmental conditions. Thus, the ground terminal contact 117 may be well suited for use in downhole environments.

C.2.18 Electrical Contact

In an embodiment, and as shown in FIGS. 4 and 6, an electrical contact 118 may comprise a connection to the ignition stack 114 that connects the ignition stack 114 and ignition device such as an ignitor 113 to an ignition power source. The electrical contact 118 may be implemented in a wide variety of ways, examples of which are set forth below.

An electrical contact 118 may comprise a pin connector including one or more pins made of conductive materials like copper or gold, ensuring good electrical conductivity. In an embodiment, the entry port has corresponding female sockets with spring-loaded contacts to create a secure connection. Particularly, the male pins are inserted into the female sockets, creating an electrical connection. Spring-loaded mechanisms in a pin connector ensure a tight fit, maintaining electrical contact despite vibrations or movements.

An electrical contact 118 may comprise a coaxial connector with a central conductor, insulator, and outer conductor for shielding against EMI (electromagnetic interference). The inner and outer conductors may be made of materials like copper or aluminum. The coaxial connector may be threaded or pushed into an ignition housing entry port, ensuring a secure connection. The shielding prevents EMI from affecting signals/power passing through the electrical contact 118.

An electrical contact 118 may comprise a circular connector that includes multiple pins arranged in a circular pattern within the connector. The pins may be made of any suitable conductive materials. The circular connector may interact with an ignition housing entry port. In particular, the circular connector may be twisted and/or pushed into the entry port, aligning the pins for contact. A locking mechanism, such as a bayonet mount, may secure the connection.

An electrical contact 118 may comprise a magnetic connector that includes magnets may embedded in the male and female connectors to facilitate self-alignment of the two connectors with each other. The electrical contacts may be made of materials such as gold for good conductivity. With regard to their interaction with an ignition housing entry port, the magnetic connectors attract and self-align. The magnetic force ensures a reliable connection while allowing for easy disconnection.

An electrical contact 118 may comprise a fiber optic connector that uses optical fibers made of glass or plastic for transmitting light signals. The connectors may have ceramic or metal ferrules to align and protect the fiber ends. To interact with an ignition housing entry port, the fiber optic connectors are aligned and inserted into the entry port. Precise alignment ensures efficient light signal transmission.

An electrical contact 118 may comprise a USB connectors Pins may be made of materials such as copper with gold plating for conductivity. To interact with an ignition housing entry port, USB connectors may be inserted into the entry port, with a distinct design for proper alignment. The connector may feature a locking mechanism for a secure connection.

An electrical contact 118 may comprise pogo pins that use spring-loaded mechanisms for electrical contact. The pins may be made of materials like gold or steel for durability. To interact with an ignition housing entry port, pogo pins may be compressed and inserted into the entry port. The spring-loaded configuration may ensure continuous contact even with minor misalignments.

As a final example, an electrical contact 118 may comprise an insulated wire that includes a conductive core made of copper or aluminum for electrical conduction. Insulation materials such as PVC, Teflon, or rubber protect the conductive core. To interact with an ignition housing entry port, the stripped end of the insulated wire is connected to the entry port. Termination methods such as soldering or crimping may secure the wire in place.

C.2.19 Barrel

As shown in FIG. 6, a barrel 119, which may be a barrel of a perf gun, may be configured to hold the GS 100 and fire an associated projectile, such as a KEPR, and may be constructed with materials capable of withstanding extreme pressures and temperatures. The barrel may comprise rifling and precision machining to enhance GS 100 and KEPR stability.

C.2.20 Ground Point

As shown in FIG. 6, a ground point 120 comprises the contact area of the GS 100 GS 100 with the barrel 119. The ground point 120 may be located on the bearing surface 102 of the GS 100. The ground point 120 may enable electrical current to pass from the GS 100 to ground by way of the barrel 119.

C.2.21 Propellant Chamber

As shown in FIG. 6, a propellant chamber 121 may be configured to contain and encapsulate propellants and a portion, or portions, of the GS 100. It is noted that, as best shown in FIG. 6, the GS 100 may be partly received in the propellant chamber 121 and, as such, when propellant(s) in the propellant chamber 121 are ignited, the gas resulting from that ignition may tend to flow upward—viewed from the perspective shown in FIG. 6—from the propellant chamber 121 in the direction of, and into, the barrel 119. Given this flow direction of the gas(es), reference may be made herein to a component as being 'upstream' or 'downstream' with respect to another component. By way of illustration, and with reference again to FIG. 6, the compensator 103 may be considered as being downstream of the gas valve 105.

The described embodiments are to be considered in all respects only as illustrative and not restrictive. All changes which come within the meaning and range of equivalency of the claims are to be embraced within their scope.

The invention claimed is:

1. A sabot, comprising:

a body configured to be partly received within a propellant chamber of a perf gun, and the body comprises an interface configured to engage a projectile;

a divider that defines part of the interface;

an ignition pass through that extends through the divider;

an ignition stack electrically connected to the ignition pass through;

a ground terminal electrically connected to the ignition pass through;

a deflector defined by the divider and having a cup-shaped configuration, and the deflector is configured to expand diametrically upon ignition of a propellant in the propellant chamber when the sabot is positioned within the propellant chamber;

a gas valve configured and arranged to be actuated by expansion of the deflector; and a compensator positioned between the interface and the gas valve.

2. The sabot as recited in claim 1, wherein the sabot comprises a unified, single-piece, construction.

3. The sabot as recited in claim 1, wherein the projectile comprises a kinetic energy perforating round (KEPR).

4. The sabot as recited in claim 1, wherein the interface is sized and configured to engage projectiles of various different calibers.

5. The sabot as recited in claim 1, wherein the ignition stack comprises an ignitor connected to the ignition pass through and configured to be positioned in the propellant chamber when the sabot is received in the propellant chamber.

6. The sabot as recited in claim 1, wherein an exterior portion of the body defines a bearing surface that contacts an interior of a barrel of the perf gun when the sabot is loaded in the perf gun.

7. The sabot as recited in claim 6, wherein the bearing surface serves as an electrical contact that forms part of a communications circuit and/or a power circuit.

8. The sabot as recited in claim 1, wherein the sabot is reusable for multiple projectile firing operations.

9. The sabot as recited in claim 1, wherein the interface defines a volume that is cylindrical in shape and is configured to receive part of the projectile.

10. The sabot as recited in claim 1, wherein the ignition stack extends out of the interface such that when the sabot is engaged with a projectile, part of the ignition stack extends into the projectile.

11. The sabot as recited in claim 1, wherein the ignition stack comprises an ignitor that is electrically connected to the ground terminal.

12. An assembly, comprising:

a projectile; and the sabot of claim 1, wherein the sabot is engaged with the projectile.

13. The assembly as recited in claim 12, wherein the projectile comprises a KEPR (kinetic energy perforating round).

14. The assembly as recited in claim 12, comprising a perf gun configured to carry the projectile and the sabot.

* * * * *